US008803757B2

(12) United States Patent
Shen et al.

(10) Patent No.: US 8,803,757 B2
(45) Date of Patent: Aug. 12, 2014

(54) PATCH ANTENNA, ELEMENT THEREOF AND FEEDING METHOD THEREFOR

(75) Inventors: Lin-Ping Shen, Ottawa (CA); Nasrin Hojjat, Ottawa (CA)

(73) Assignee: TENXC Wireless Inc., Ontario (CA)

( * ) Notice: Subject to any disclaimer, the term of this patent is extended or adjusted under 35 U.S.C. 154(b) by 682 days.

(21) Appl. No.: 13/062,445

(22) PCT Filed: Sep. 11, 2009

(86) PCT No.: PCT/CA2009/001262
§ 371 (c)(1),
(2), (4) Date: Apr. 28, 2011

(87) PCT Pub. No.: WO2010/028491
PCT Pub. Date: Mar. 18, 2010

(65) Prior Publication Data

US 2011/0199279 A1 Aug. 18, 2011

Related U.S. Application Data

(60) Provisional application No. 61/136,560, filed on Sep. 15, 2008.

(51) Int. Cl.
*H01Q 1/50* (2006.01)

(52) U.S. Cl.
USPC ..... 343/857

(58) Field of Classification Search
USPC ..... 343/857
See application file for complete search history.

(56) References Cited

U.S. PATENT DOCUMENTS 5,006,859 A * 4/1991 Wong et al. ..... 343/700 MS
7,084,815 B2 * 8/2006 Phillips et al. ..... 343/700 MS
7,142,164 B2 * 11/2006 Legay et al. ..... 343/754

* cited by examiner

*Primary Examiner* — Kristy A Haupt
(74) *Attorney, Agent, or Firm* — Kilpatrick Townsend & Stockton LLP

(57) ABSTRACT

Various embodiments of a patch antenna, element thereof and method of feeding therefor are described. In general, the patch antenna is configured to generate orthogonal beams and comprises an array of patch elements each contributing to the orthogonal beams and comprising one or more resonators, a base reflector, and a dual feed mechanism. The dual feed mechanism generally comprises two pairs of feeding elements, each one of which comprising substantially balanced feeds configured to drive a respective one of the orthogonal beams via substantially anti-phase capacitive coupling.

28 Claims, 15 Drawing Sheets

PATCH ANTENNA, ELEMENT THEREOF AND FEEDING METHOD THEREFOR

FIELD OF THE INVENTION

The invention relates to antenna technology. More specifically, the invention relates to a patch antenna, element thereof and feeding method therefor.

BACKGROUND

Patch antennas are generally well known in the art and generally consist of a metal or conductive patch suspended over a ground plane. The assembly is usually contained in a plastic radome, which protects the structure from damage. Similar to patch antennas, microstrip antennas generally provide a similar configuration constructed on a dielectric substrate, usually employing the same sort of lithographic patterning used to fabricate printed circuit boards. Since both types of antennas share similar features and rely on similar operational principles, the following description will refer mainly to patch antennas, with the understanding that a person of skill in the art could equally apply the principles and concepts discussed herein to the fabrication of a microstrip antenna.

Each patch antenna will generally comprise a radiating patch suspended or otherwise disposed over a larger ground plane, with one or more feed mechanisms provided to operate the antenna. Common radiating patch shapes are square, rectangular, circular and elliptical, but other continuous shapes are generally possible. Because such antennas have a very low profile, are mechanically rugged and can be conformable, they are often mounted on the exterior of aircraft and spacecraft, or are incorporated into mobile radio frequency (RF) communication devices and systems, for example mounted at base stations or the like.

Patch antennas are also relatively inexpensive to manufacture and design because of their comparatively simple two-dimensional physical geometry. In many cases, an array of patches can be manufactured and/or mounted in a combined fashion to provide greater operating performance (e.g. higher gain, beam shaping, etc.). For example, an array of patches can be printed on a single substrate using lithographic techniques, or the like, which can provide much higher performances than a single patch at little additional cost.

An advantage inherent to patch antennas is the ability to have polarization diversity. For example, a patch antenna can be designed to have Vertical, Horizontal, Right Hand Circular (RHCP) or Left Hand Circular (LHCP) Polarizations, using multiple feed points, or a single feed point with asymmetric patch structures, for example. This property allows patch antennas to be used in many types of communication links that may have varied requirements. For instance, in a beam-formed or steerable antenna system, such as may be used in base stations for cellular telephone networks, an antenna may be comprised of an array of identical antenna elements and a dual feed network enabling the dual feeding of each patch element to emanate a radiation pattern comprising orthogonally polarized beams. Therefore, care should be taken to design a patch element that provides satisfactory performance while satisfying the various design criteria of the radiating element. In one such example, the two polarizations are set at +/−45°, as provided by a square patch radiator oriented along a diagonal relative to the array.

As introduced above, different feed mechanisms have been developed to operate patch antennas; examples of such feed mechanism include, for instance, patch edge feeding mechanisms, probe feeding mechanisms, aperture-coupling feeding mechanisms, capacitive feeding mechanisms and the like. In particular, due to its wide bandwidth nature, capacitive feed mechanisms have been of particular interest. In general, as described in the below-cited articles, traditional capacitive feed mechanisms involve the capacitive coupling of the radiating patch (resonator) with a feeding pad or element disposed in a coplanar fashion at a selected distance away from the patch. In dual capacitive feeding, one such feeding pad is generally provided for each polarization. While this configuration may provide some advantages in the fabrication of such antennas (i.e., simple structure and single layer combination), various drawbacks present themselves, particularly, in wide-band planar array applications. Such drawbacks may include, but are not limited to, poor return loss (RL), narrow bandwidth (BW), low isolation (ISO) between two dual polarizations, low cross polarization discrimination (XPD) within the antenna element, and poor mutual coupling (MC) between antenna elements.

Different solutions have been proposed to overcome at least some of these drawbacks, as described in the following articles: A Broadband Microstrip Antenna by J. S. Roy, Microwave and Optical Technology Letters (Vol. 19, No. 4); Single Layer Capacitive Feed for Wideband Probe-Fed Microstrip Antenna Elements by G. Mayhew-Ridgers et al., IEEE Transactions on Antennas and Propagation (Vol. 51, No. 6); Efficient Full Wave Modeling of Patch Antenna Arrays with new Single-Layer Capacitive Feed Probes by G. Mayhew-Ridgers et al., IEEE Transactions on Antennas and Propagation (Vol. 53, No. 10); Wideband Quarter-Wave Patch Antenna with a Single-Layer Capacitive Feed on a Finite Ground Plane by J. Joubert et al., Microwave and Optical Technology Letters (Vol. 45, No. 3); Probe Compensation in Thick Microstrip Patches by S. Hall, Electronic Letters (Vol. 23 No.11); and Single Patch Broadband Circularly Polarized Microstrip Antennas by Kin-Lu et al., (IEEE-APS symposium 2000).

While some performance improvements may be observed using these solutions, relatively poor ISO and XPD within the antenna element, and poor MC between array elements, for example in the context of a planar bi-sector array but also in other applications, as will be appreciated by the person of skill in the art, generally yield high side lobe levels and low gains, and so cannot be used in a real system because of system capacity and coverage limitations.

Therefore there is a need for a new patch antenna, element thereof and feeding method therefor that overcome some of the drawbacks of known technology, or alternatively, provides the public with a new and useful alternative to such technology.

This background information is provided to reveal information believed by the applicant to be of possible relevance to the invention. No admission is necessarily intended, nor should be construed, that any of the preceding information constitutes prior art against the invention.

SUMMARY OF THE INVENTION

An object of the invention is to provide a new patch antenna.

A further or alternative object of the invention is to provide a new patch antenna element.

A further or alternative object of the invention is to provide a new feeding method for patch antennae and/or elements thereof.

In accordance with one embodiment, there is provided a patch antenna element for generating orthogonal beams comprising one or more resonators, a base reflector, and a dual feed mechanism, said dual feed mechanism comprising two pairs of feeding elements, each of said pairs comprising substantially balanced feeds configured to drive a respective one of the orthogonal beams via substantially anti-phase capacitive coupling.

In accordance with another embodiment, there is provided a patch antenna for generating orthogonal beams comprising an array of patch elements each contributing to the orthogonal beams and comprising one or more resonators, a base reflector, and a dual feed mechanism, said dual feed mechanism comprising two pairs of feeding elements, each of said pairs comprising substantially balanced feeds configured to drive a respective one of the orthogonal beams via substantially anti-phase capacitive coupling.

In accordance with another embodiment, there is provided a method of generating orthogonal beams using a patch antenna element comprising one or more resonators, the method comprising: capacitively coupling two pairs of substantially balanced feeding elements to the one or more resonators; and driving said feeding elements of each of said pairs via respective anti-phase signals to respectively generate the orthogonal beams.

Other aims, objects, advantages and features of the invention will become more apparent upon reading of the following non-restrictive description of specific embodiments thereof, given by way of example only with reference to the accompanying drawings.

BRIEF DESCRIPTION OF THE FIGURES

The embodiments of the invention will now be described by reference to the following figures, in which similar reference numerals in different embodiments indicate similar elements and in which.

DETAILED DESCRIPTION OF THE INVENTION

Figure 1:
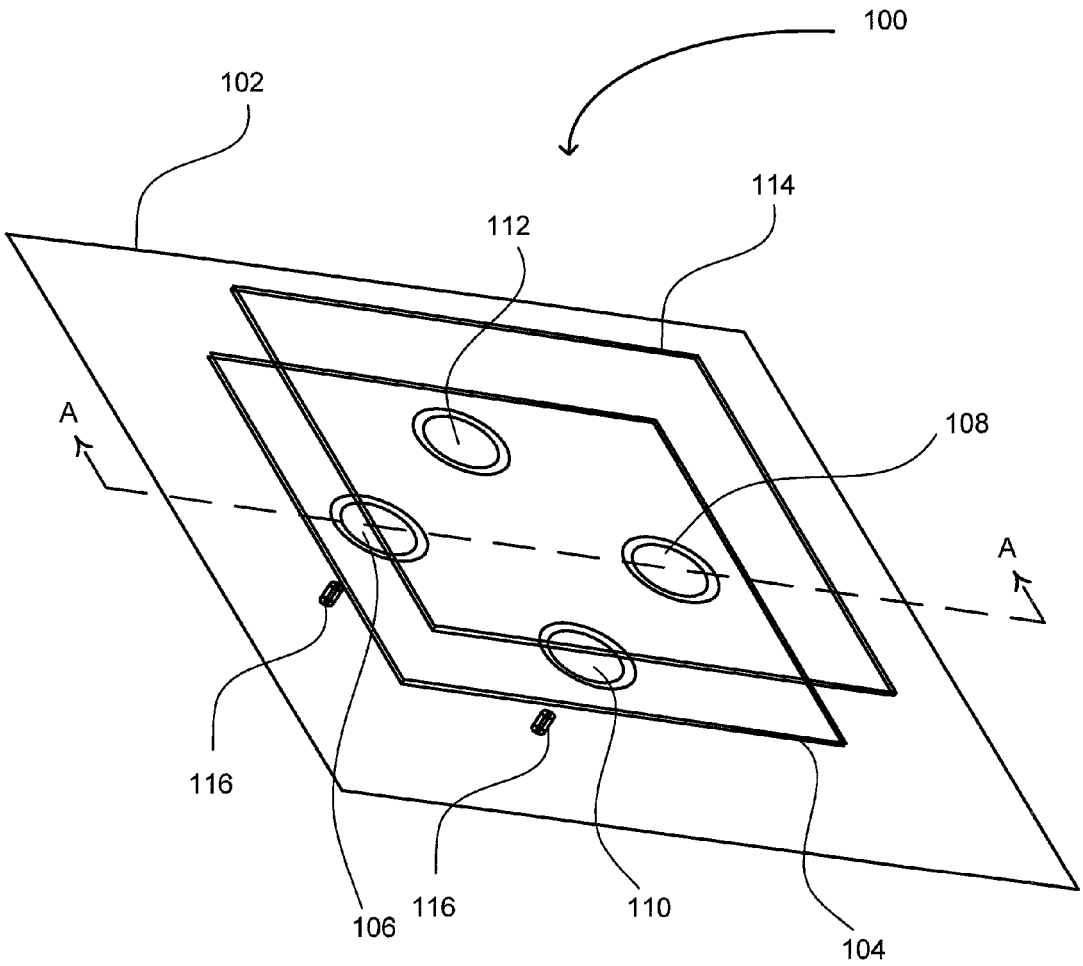
FIG. 1 is a perspective view of a patch element of an antenna, showing a radiating element thereof in transparency, in accordance with one embodiment of the invention.

In general, the following describes various embodiments of an antenna and patch element therefor. In general, the patch element comprises a base reflector, one or more resonators, and a dual capacitive feed mechanism for driving respective orthogonal beams. In one embodiment, the feeding mechanism comprises a dual polarization feed mechanism comprising two pairs of feeding elements, each one of which comprising a pair of substantially balanced feeding elements to be driven by substantially anti-phase signals. As introduced above, examples of orthogonal beams may include linearly polarized beams (e.g. horizontal and vertical, +/−45 degrees, etc.), circularly (or elliptically) polarized beams (RHCP and LHCP, for example generated via respective quadrature phase signals) and the like, as will be readily apparent to the person of skill in the art.

As will be described below, in some embodiments, the provision of an anti-phase substantially balanced dual polarization capacitive feed mechanism may result in patch element performance improvements, and therefore improvements in the performance of an antenna or antenna array comprising same. In some embodiments, improvements can be observed in one or more of the return loss (RL) of an element, the isolation (ISO) of an element and/or mutual coupling (MC) between elements. In some embodiments, improvements may also, or alternatively, be observed in the generation of relatively lower side lobe level and cross polarization levels, for example, in the context of planar arrays such as bi-sector arrays. Accordingly, using this approach, an improved dual polarization feed patch antenna element may be provided resulting in higher performance and/or lower cost.

In one embodiment, for example, the patch element is configured for use in a planar antenna array with few columns (e.g. three, four, or six columns) and high excitation ratios, such as a bi-sector array antenna, for example. Due to beam requirements for low side lobes and XPD, the ISO and XPD between polarizations within the antenna element and the MC between elements can become relatively important to the performance of such arrays. As will be appreciated by the person of skill in the art, cost constraints for volume production can be mitigated while attending to the above requirements using the capacitive-coupling technique described herein. It will be appreciated that the advantages provided by the various embodiments of the invention described herein, and equivalents thereto, may be amenable to different applications, some of which being exemplarily described herein. For instance the low XPD and improved MC provided by some of these embodiments can be advantageously applied to different linear arrays, for example including $4^{th}$ generation (4G) systems such as Long Term Evolution (LTW), WiMAX and other such systems, as well as MIMO (multiple-input and multiple-output) applications for polarization diversity, to name a few. The reduced MC of these embodiments may also be advantageously used to improve the performance of space and/or satellite communication arrays. In general, as patch antennas are commonly used in a variety of applications, which may include but are not limited to, cellular, GPS, WLAN, Bluetooth, satellite and other such communication systems, the operational advantages of the embodiments proposed herein may, depending on the application, be relevant to the implementation of different applications for such systems.

As will be described in greater detail below, various patch and feed mechanism configurations may be considered within the present context, without departing from the general scope and nature of the present disclosure. For example, as will be exemplified by the illustrative embodiment described below, various arrangements of the patch's one or more resonators, feeding elements and the like may lead to similar improvements, with certain configurations being conducive to particular improvements. For example, in one embodiment, the feeding elements, or a subset thereof, may be disposed within an area circumscribed by the periphery of the one or more resonators, that is, an area of these resonators. In such embodiments, for example, the MC between array elements can be reduced, and therefore, the phase and amplitude errors due to multi-reflection between the patch elements and a beam-forming network (BFN) of a beam forming or beam steering antenna array, as the case may be, can also be reduced thereby improving the performance of such antenna array. In a same or alternative embodiment, additional parasitic patches or resonators (e.g. stacked patches for array applications) can be provided to improve bandwidth, for example. These and other such examples will become apparent to the person of ordinary skill in the art upon reading the following description of illustrative embodiments.

In addition, it will be appreciated by the person of ordinary skill in the art that various materials may be used in manufacturing the various embodiments of the patch antenna element, antenna and arrays described herein. For example, in one embodiment, one or more of the one or more resonators comprises a metal sheet or the like (e.g. aluminium or other such conductive materials such as copper, silver, iron, brass, tin, lead, nickel, gold and mixtures thereof), which may be square, rectangular or other shapes readily known in the art for this type of antenna. In another or same embodiment, one or more of the one or more resonators may comprise conductive sheet printed or otherwise disposed on or embedded in a dielectric material or the like (e.g. Duroid®, Gtek®, FR-4®, and mixtures thereof). It may also be printed using suitable high conductivity inks. Such printed patch resonators may be printed on a supporting board structure or the like mounted within the antenna element via mounting holes and supported above or between other elements structures via appropriate support structures or the like (e.g. see FIG. 9). This supporting board may be manufactured using a variety of materials such as foam, sheet or composite dielectric materials, and other such materials readily known in the art. For example, suitable foam dielectrics may include polystyrene, polyurethane, or a mixture thereof. Suitable sheet dielectrics may include polystyrene, polycarbonate, Kevlar®, Mylar® or different mixtures thereof. Suitable composite dielectrics may include Duroid®, Gtek®, FR-4®, or different mixtures thereof. Alternative support structures would also be known to skilled practitioners in the art, and could thus be substituted without departing from the general scope and nature of the present disclosure.

Furthermore, the one or more resonators may be suspended or otherwise maintained at a distance from the base, generally separated by a dielectric material. For example, in one embodiment, a resonator and base are separated by a solid dielectric material providing said separation. In another embodiment, the resonator is suspended from the base via one or more posts, for example manufactured of a plastic or the like, wherein the dielectric separating these components comprises air. In such embodiments, for example, the suspended configuration of the patch may result in lower losses. In yet another embodiment, the patch element may comprise a printed patch such as common in microstrip antennas. These and other such examples will be appreciated by the person of skill in the art to fall within the context of the present disclosure.

Figure 2:
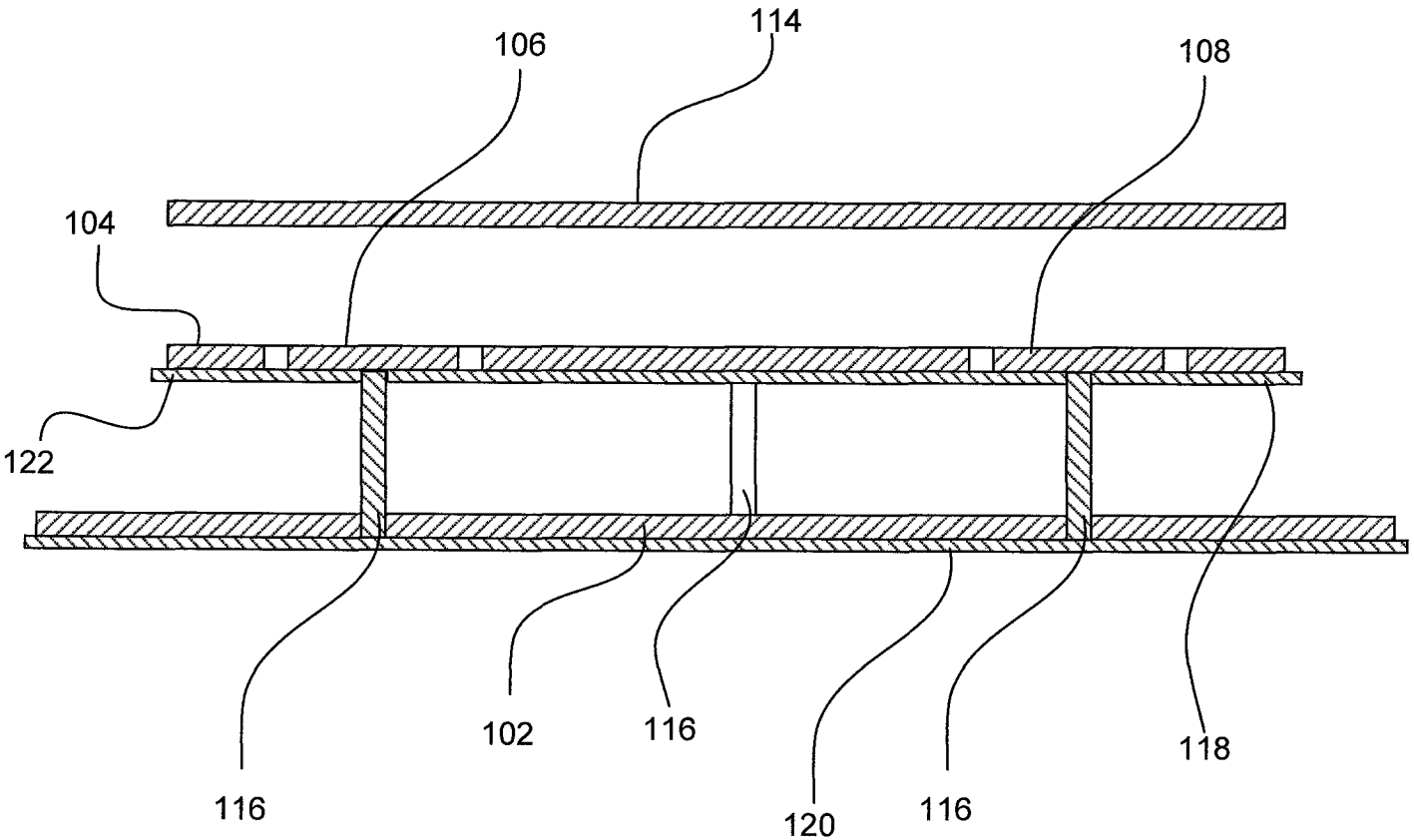
FIG. 2 is a cross-sectional view of the patch element of FIG. 1 taken along line A-A thereof.

Referring now to FIGS. 1 and 2, and in accordance with one embodiment of the invention, a patch element, generally referred to using the numeral 100, will now be described. In this embodiment, the patch element comprises a layered architecture comprising in sequence a base reflector 102, a feed mechanism comprising two pairs of diametrically opposed feeding elements (e.g. feed pads 106 and 108, and 110 and 112 respectively, which may be circular, as depicted, or square, rectangular or of another shape as will be appreciated by the person of skill in the art) and two resonators 104 and 114 respectively. In this embodiment, the feed pads 106 to 112 are fed by respective feed structures 116 and disposed for capacitive coupling to the resonators 104 and 114, wherein each pair is configured to feed a respective beam polarization substantially orthogonal to the other, resulting in a substantially balanced dual polarization feed capacitively coupled patch element. In this embodiment, the feed pads 106 to 112 are disposed within an area circumscribed by the periphery of the resonators 104 and 114.

Figure 10:
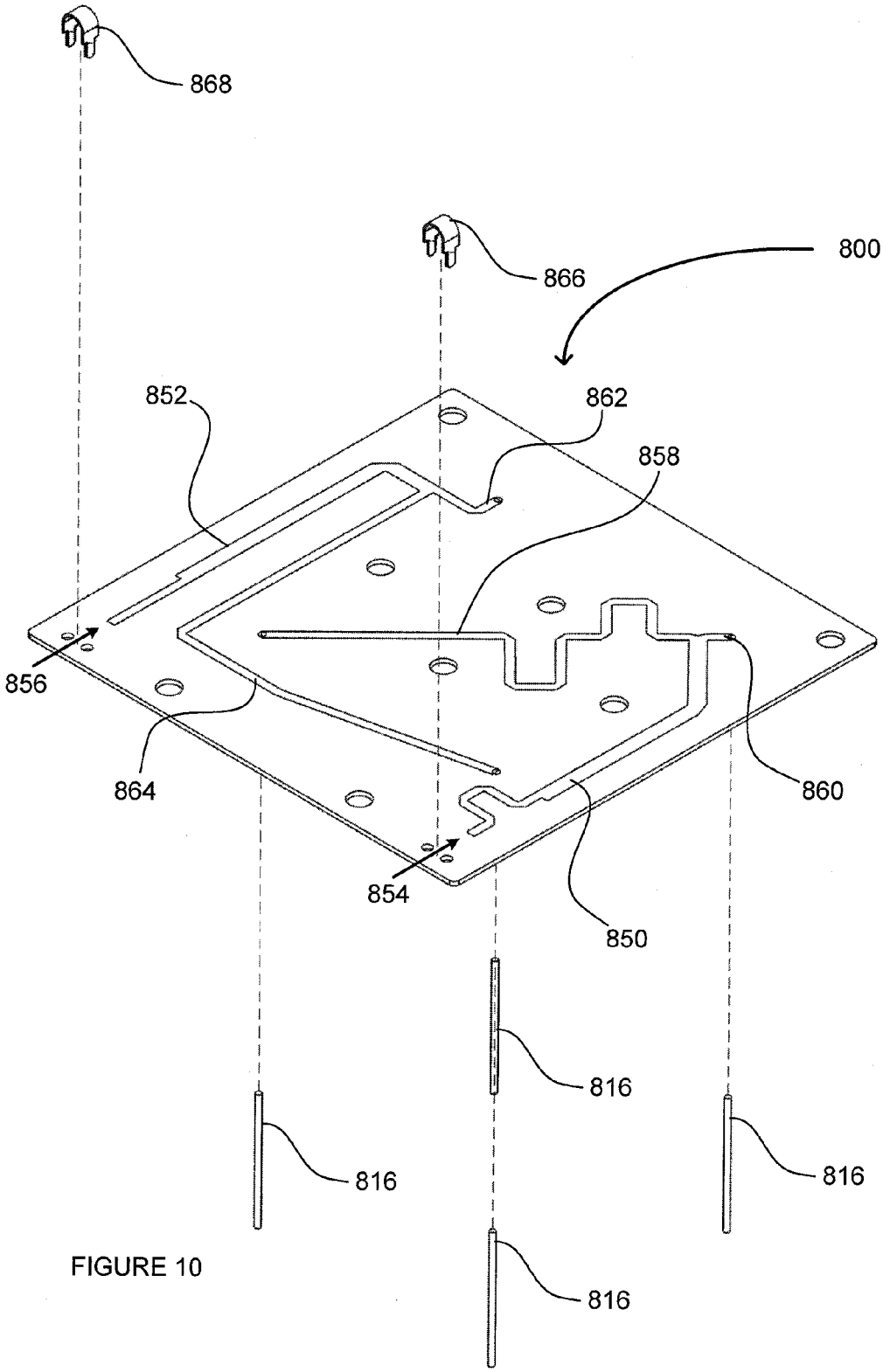
FIG. 10 is a perspective view of an exemplary anti-phase feeding network for a patch element, in accordance with one embodiment of the invention.

As depicted in FIGS. 1 and 2, the first resonator 104 generally comprises a conductive plate or layer disposed in a coplanar fashion relative to the feeding elements 106 to 112, wherein these feeding elements are provided within a periphery defined by the resonator 104. In this embodiment, as better seen in FIG. 2, both the resonator 104 and feeding elements 106 to 112 comprise conductive elements printed or otherwise disposed on a dielectric sheet 122 or the like, thereby reducing manufacturing costs without significantly reducing operability. The feed structures 116 are inserted through the sheet 122 and extend therefrom through the base 102 for operative coupling to driving circuitry, for example provided by a printed circuit board (PCB) 120 or the like, for example as shown in FIG. 10. Alternatively, these components may comprise metallic or otherwise conductive sheets suspended over the base 102, for example via appropriate posts, spacers or the like. It will be appreciated that in some embodiments, a PCB configured to drive the feeding elements may further double as the base reflector.

Figure 9:
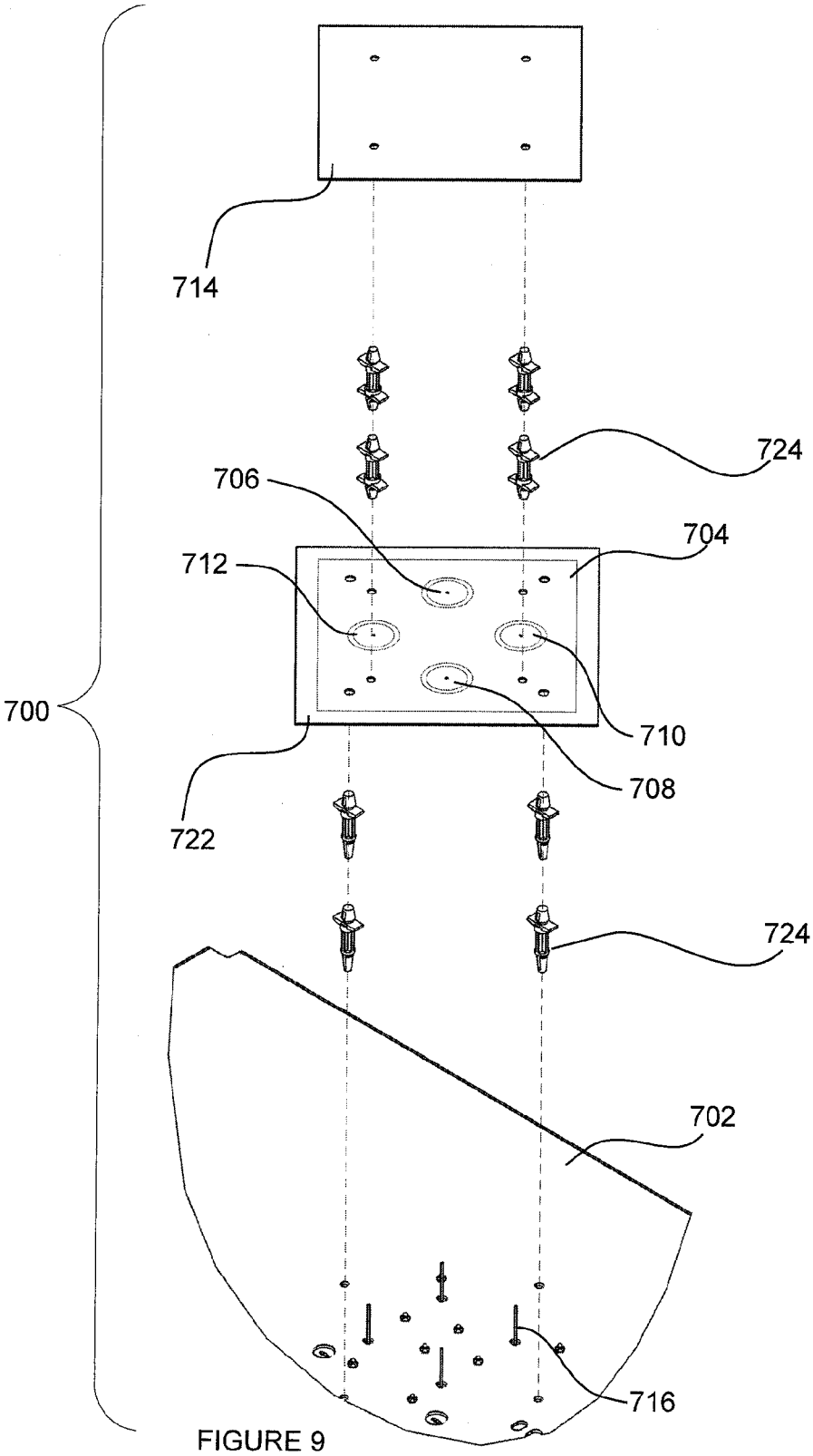
FIG. 9 is an exploded view of an exemplary patch element comprising stacked resonating elements, in accordance with one embodiment of the invention.

With reference to FIG. 9, and in accordance with an exemplary embodiment of the invention, a detailed patch element architecture is shown, similar to that described above with reference to FIGS. 1 and 2. Namely, the patch element 700 again comprises a layered architecture comprising in sequence a base reflector 702 (provided herein by a metallic structure supporting the patch element, such as part of an antenna array or the like shown in FIG. 15), a feed mechanism comprising two pairs of diametrically opposed feeding elements (e.g. feed pads 706 and 708, and 710 and 712 respectively) and two resonators 704 and 714 respectively. In this embodiment, the feed pads 706 to 712 are fed by respective feed structures 716 and disposed for capacitive coupling to the resonators 704 and 714, wherein each pair is configured to feed a respective beam polarization substantially orthogonal to the other, resulting in a substantially balanced dual polarization feed capacitively coupled patch element. In this embodiment, again, the feed pads 706 to 712 are disposed within an area circumscribed by the periphery of the resonators 704 and 714, and configured for coplanar capacitive coupling to resonator 704 and layered capacitive coupling to resonator 714. Once again, feed structures 716 are inserted through the feeding element support sheet 722 and extend therefrom through the base 702 for operative coupling to driving circuitry, for example provided by a PCB, such as shown in FIG. 10. Appropriate support structures, such as non-conductive posts or spacers 724, are disposed between the resonators and the base. It will be appreciated by the person of skill in the art that various alternative mounting and/or support structures may be considered herein to provide appropriate spacings between patches and/or between a patch and base reflector, without departing from the general scope and nature of the present disclosure.

As shown in FIG. 10, a PCB 800, can be configured to construct and impart the appropriate anti-phase signals to respective feeding elements of each feeding pair via appropriate conductive traces, wherein for example, traces 850 and 852 are initially energized by respective coaxial cables (shown as representative arrows 854 and 856) operatively coupled thereto and fastened to the PCB 800 via clips or fasteners 866 and 868, and respectively branch out to each feeding element of each feeding element pair (not shown) via respective trace portions 858 and 860, and 862 and 864, and respective feed structures 816, thereby imparting the appropriate anti-phase signals to each feeding element pairs. Other methods and devices suitable for the construction of anti-phase signals, such as various cable (e.g. 50 Ohm cables), conductive and/or otherwise appropriate signalling techniques, should be readily apparent to the person of ordinary skill in the art and are therefore not meant to depart from the general scope and nature of the present disclosure. In one embodiment, however, the feeding network is provides a simplified transition form to the feeding elements of the patch, i.e. providing a relatively simple transition of relatively low complexity, thereby alleviating design and manufacturing costs.

Figure 3:
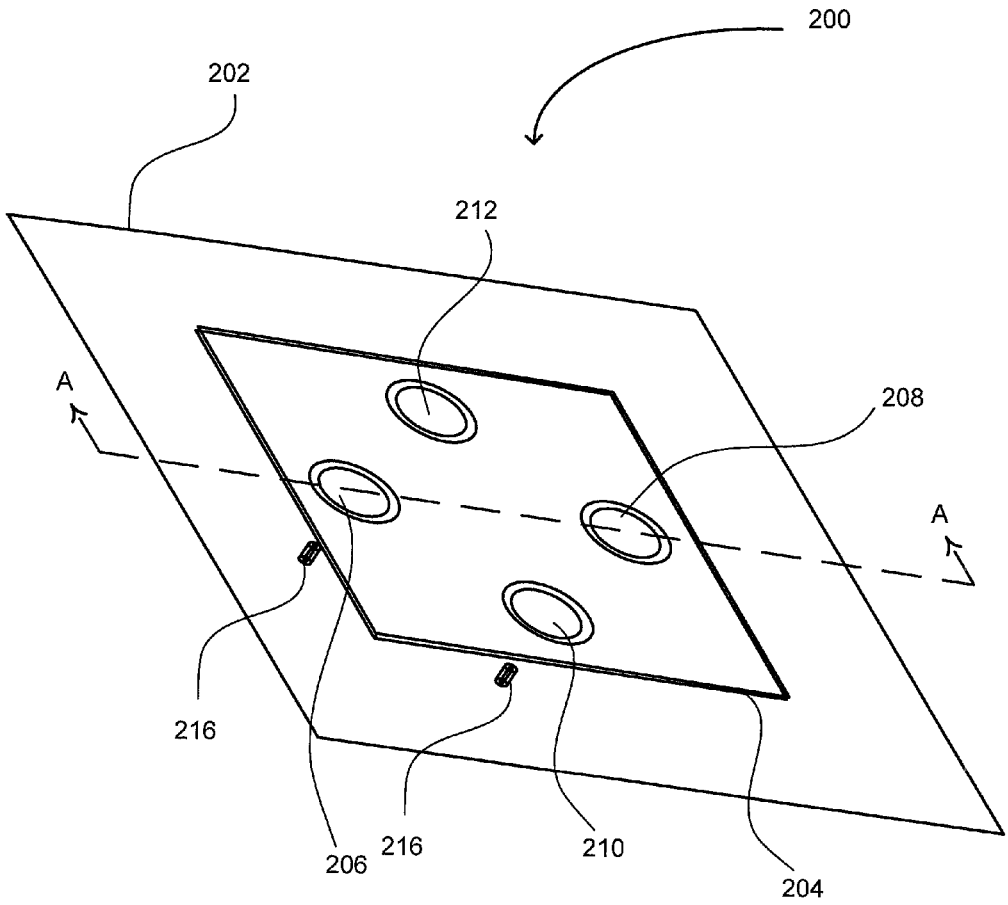
FIG. 3 is a perspective view of a patch element of an antenna, in accordance with another embodiment of the invention.
Figure 4:
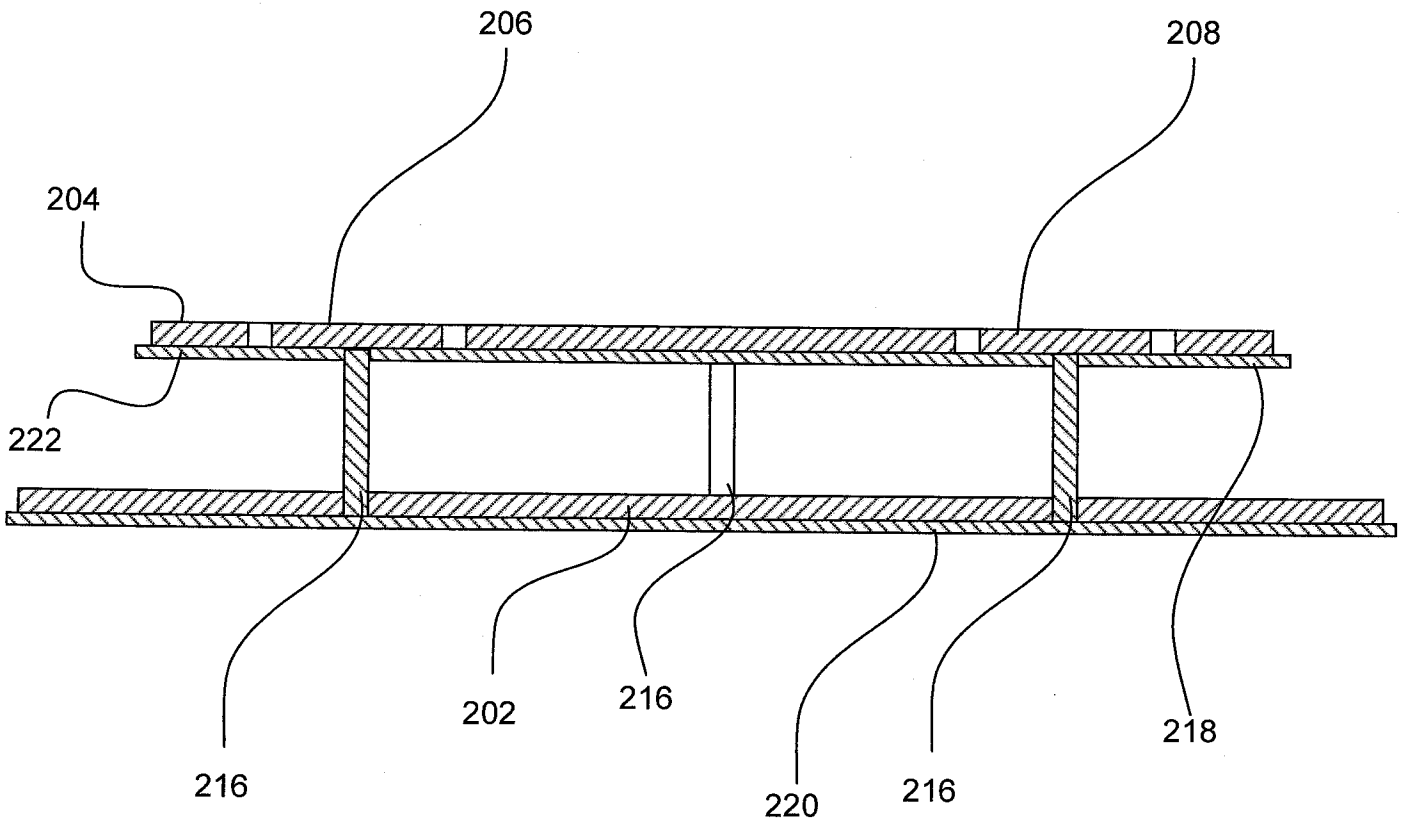
FIG. 4 is a cross-sectional view of the patch element of FIG. 3 taken along line A-A thereof.

Referring now to FIGS. 3 and 4, and in accordance with one embodiment of the invention, a patch element, generally referred to using the numeral 200, will now be described. In this embodiment, the patch element comprises a layered architecture comprising in sequence a base reflector 202, a feed mechanism comprising two pairs of diametrically opposed feeding elements (e.g. feed pads 206 and 208, and 210 and 212 respectively) and a resonator 204. In this embodiment, the feed pads 206 to 212 are fed by respective feed structures 216 and disposed for capacitive coupling to the resonator 204, wherein each pair is configured to feed a respective beam polarization substantially orthogonal to the other, resulting in a substantially balanced dual polarization feed capacitively coupled patch element. In this embodiment, the feed pads 206 to 212 are disposed within an area circumscribed by the periphery of the resonator 204.

As depicted in FIGS. 3 and 4, the resonator 204 generally comprises a conductive layer disposed in a coplanar fashion relative to the feeding elements 206 to 212, wherein these feeding elements are provided within a periphery defined by the resonator 204. In this embodiment, as better seen in FIG. 4, both the resonator 204 and feeding elements 206 to 212 comprise conductive elements printed or otherwise disposed on a dielectric sheet 222 or the like, thereby reducing manufacturing costs without significantly reducing operability. The feed structures 216 are again inserted through the sheet 222 and extend therefrom through the base 202 for operative coupling to driving circuitry, for example provided by a printed circuit board (PCB) 220 or the like as shown in FIG. 10. Alternatively, these components may comprise metallic or otherwise conductive sheets suspended over the base 202, for example via appropriate posts, spacers or the like. As described with reference to FIGS. 1 and 2, and for example in order to increase the bandwidth of the patch element 200, an additional resonator, such as resonator 114 of FIGS. 1 and 2, can be stacked to the element 200.

Figure 5:
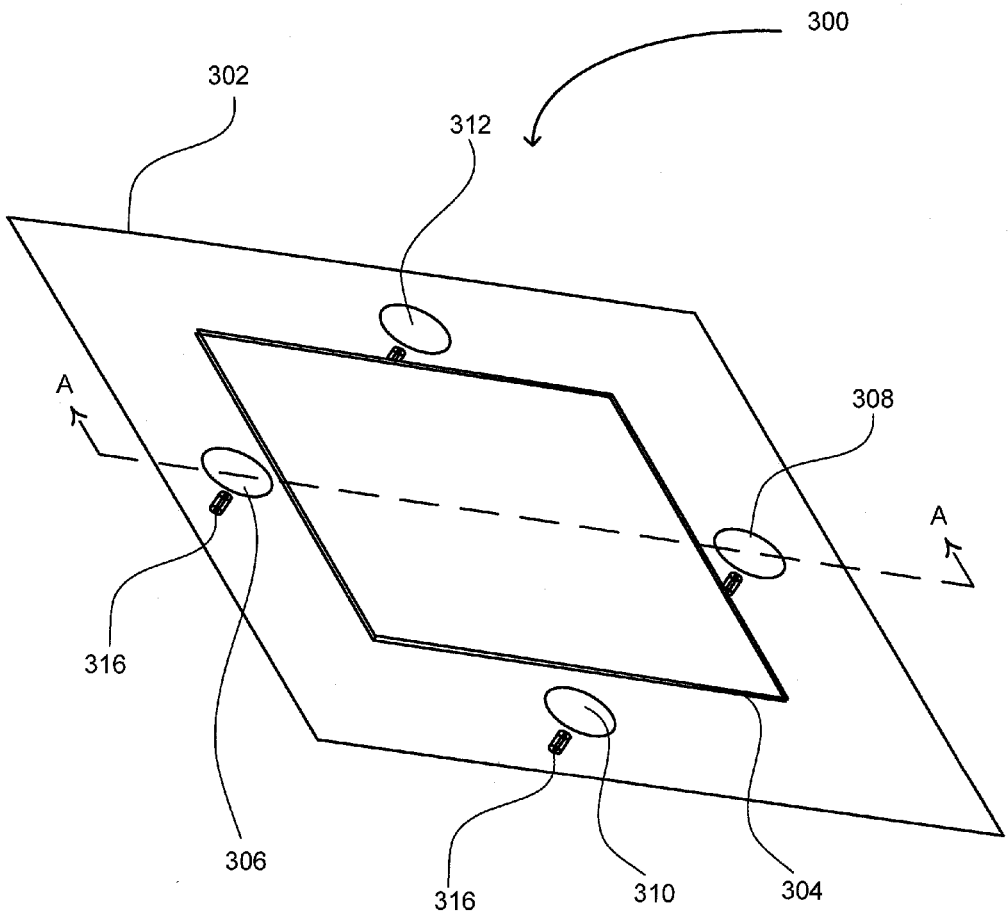
FIG. 5 is a perspective view of a patch element of an antenna, in accordance with another embodiment of the invention.
Figure 6:
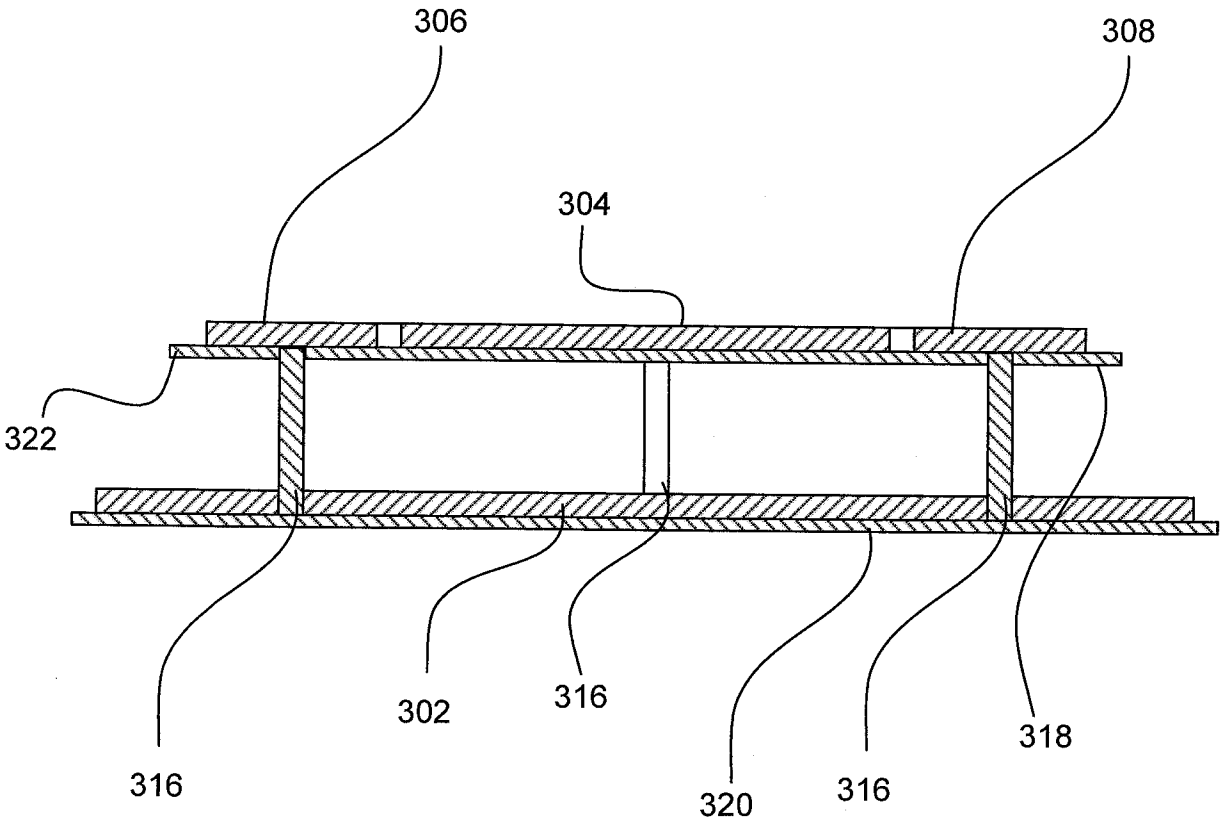
FIG. 6 is a cross-sectional view of the patch element of FIG. 5 taken along line A-A thereof.

Referring now to FIGS. 5 and 6, and in accordance with one embodiment of the invention, a patch element, generally referred to using the numeral 300, will now be described. In this embodiment, the patch element comprises a layered architecture comprising in sequence a base reflector 302, a feed mechanism comprising two pairs of diametrically opposed feeding elements (e.g. feed pads 306 and 308, and 310 and 312 respectively) and a resonator 304. In this embodiment, the feed pads 306 to 312 are fed by respective feed structures 316 and disposed for capacitive coupling to the resonator 304, wherein each pair is configured to feed a respective beam polarization substantially orthogonal to the other, resulting in a substantially balanced dual polarization feed capacitively coupled patch element. In this embodiment, the feed pads 306 to 312 are disposed outside an area circumscribed by the periphery of the resonator 304.

As depicted in FIGS. 5 and 6, the resonator 304 generally comprises a conductive layer disposed in a coplanar fashion relative to the feeding elements 306 to 312, wherein these feeding elements are provided outside a periphery defined by the resonator 304. In this embodiment the feeding elements 306 to 312 comprise conductive elements printed or otherwise disposed on a dielectric sheet 322 or the like, thereby reducing manufacturing costs without significantly reducing operability. The feed structures 316 are again inserted through the sheet 322 and extend therefrom through the base 302 for operative coupling to driving circuitry, for example provided by a printed circuit board (PCB) 320 or the like as shown in FIG. 10. Alternatively, these components may comprise metallic or otherwise conductive sheets suspended over the base 302, for example via appropriate posts, spacers or the like. As described with reference to FIGS. 1 and 2, and for example in order to increase the bandwidth of the patch element 300, an additional resonator, such as resonator 114 of FIGS. 1 and 2 can be stacked to the element 300.

Figure 7:
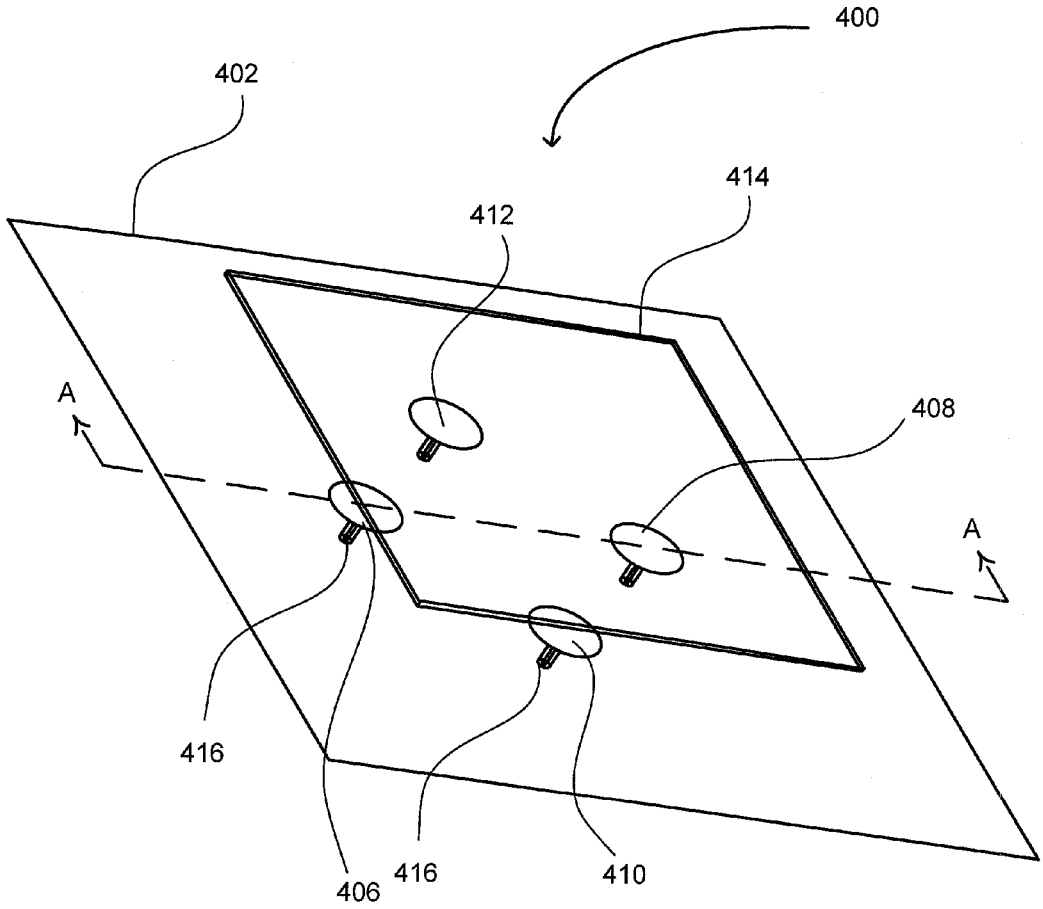
FIG. 7 is a perspective view of a patch element of an antenna, showing a radiating element thereof in transparency, in accordance with another embodiment of the invention.
Figure 8:
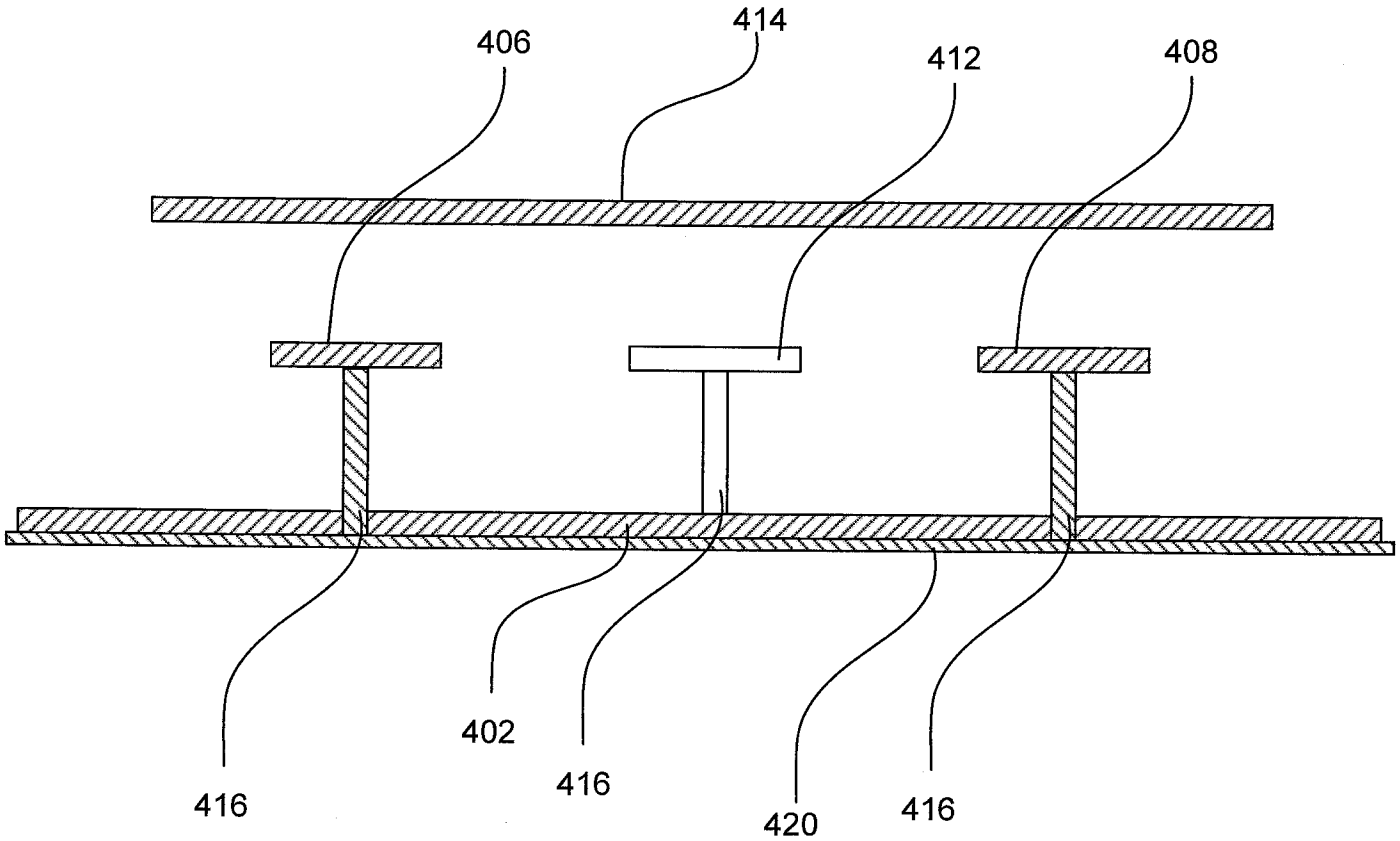
FIG. 8 is a cross-sectional view of the patch element of FIG. 7 taken along line A-A thereof.

Referring now to FIGS. 7 and 8, and in accordance with one embodiment of the invention, a patch element, generally referred to using the numeral 400, will now be described. In this embodiment, the patch element comprises a layered architecture comprising in sequence a base reflector 402, a feed mechanism comprising two pairs of diametrically opposed feeding elements (e.g. feed pads 406 and 408, and 410 and 412 respectively) and a resonator 414. In this embodiment, the feed pads 406 to 412 are fed by respective feed structures 416 and disposed for capacitive coupling to the resonator 414, wherein each pair is configured to feed a respective beam polarization substantially orthogonal to the other, resulting in a substantially balanced dual polarization feed capacitively coupled patch element. In this embodiment, the feed pads 406 to 412 are disposed within an area circumscribed by the periphery of the resonator 414.

As depicted in FIGS. 7 and 8, the resonator 414 generally comprises a conductive plate or layer disposed at a distance from and substantially parallel to the feeding elements 406 to 412, wherein these feeding elements are provided within a periphery defined by the resonator 414. In this embodiment, as better seen in FIG. 8, the feeding elements 406 to 412 generally either comprise freestanding conductive elements (e.g. supported by the feed structures and/or otherwise supported between the base 402 and resonator 414) or are printed or otherwise disposed on a dielectric sheet (not shown) or the like, as in the embodiments described above. The feed structures 416 generally extend from the feed pads through the base 402 for operative coupling to driving circuitry, for example provided by a printed circuit board (PCB) 420 or the like as shown in FIG. 10. Furthermore, for example in order to increase the bandwidth of the patch element 400, an additional resonator, such as the staked resonator 114 of FIGS. 1 and 2, can be added within the element 400, as will be appreciated by the person of skill in the art.

Figure 11:
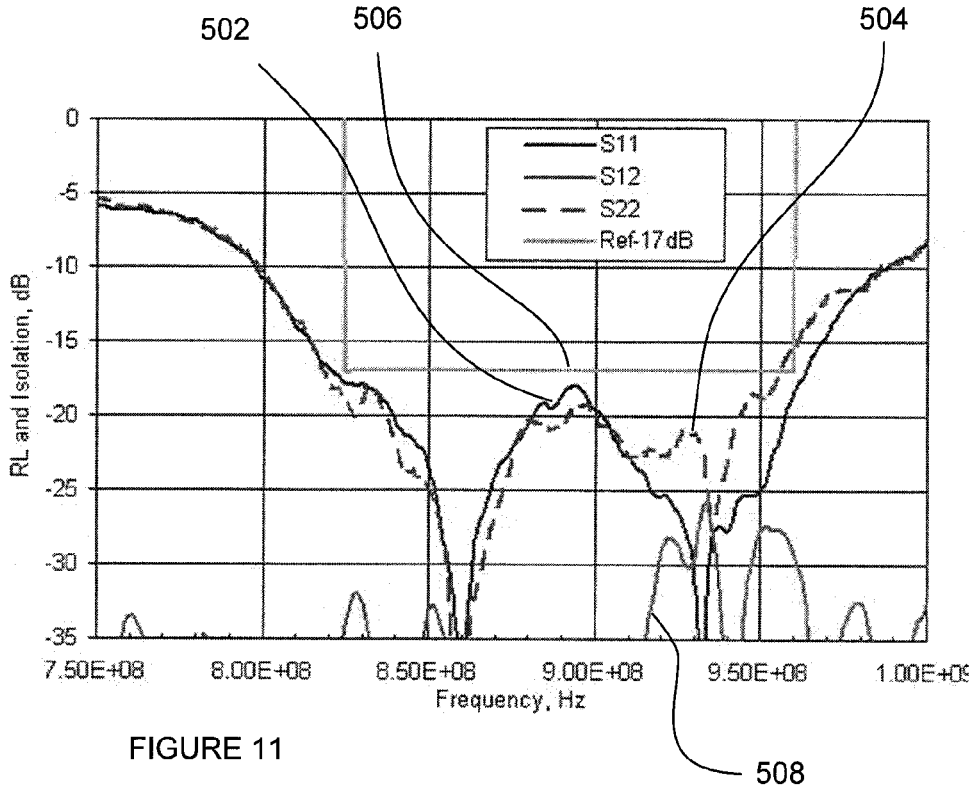
FIG. 11 is a performance plot of Return Loss (RL) and Isolation (ISO) of a patch element, in accordance with an exemplary embodiment of the invention.
Figure 12:
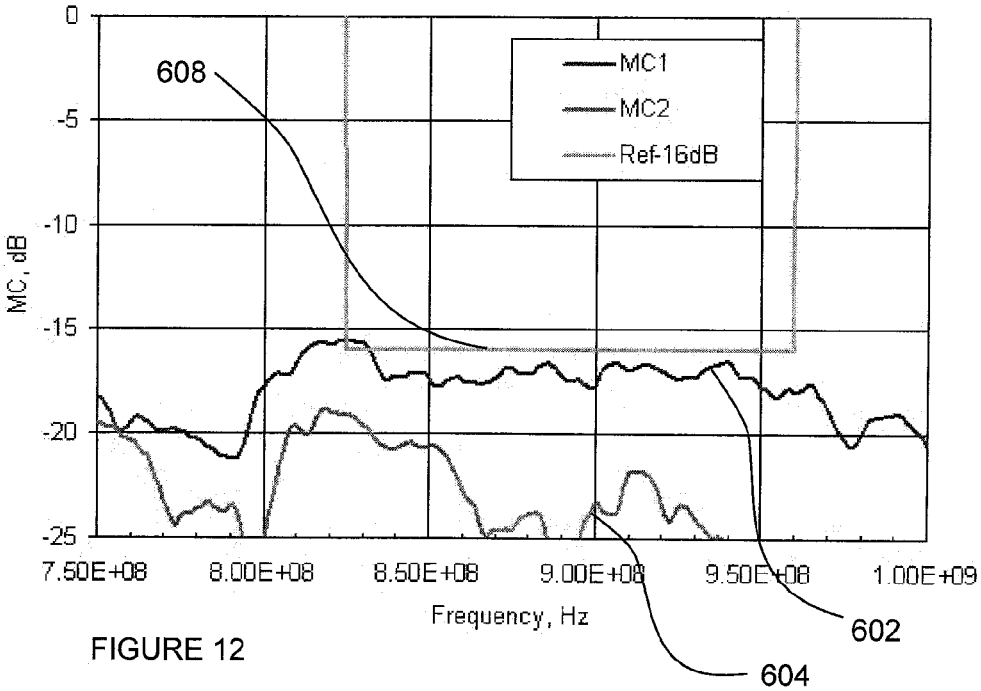
FIG. 12 is a performance plot of Mutual Coupling (MC) between patch elements, in accordance with an exemplary embodiment of the invention.

As discussed above, in order to improve the performance of an antenna element, a dual polarization capacitive feed mechanism is provided comprising two pairs of substantially balanced feeding elements driven by respective anti-phase signals, as described above with reference to the embodiments of FIGS. 1 to 10. For example, in one embodiment and as shown in FIG. 11, the measured RL and ISO of a patch element such as described above provides for an RL greater than about 17 dB for the element (i.e. see RL plot S11 (502) for one polarization input and RL plot S22 (504) for another polarization input in reference to the 17 dB line 506) and an ISO of greater than about 25 dB (i.e. see ISO plot S12 (508) between two polarization inputs). Similarly, when two antenna elements are arranged with the typical spacings such as 0.5 wavelength spacing in the azimuth plane and 0.8 wavelength spacing in the elevation plane, the MC, as shown in FIG. 12, is greater than about 16 dB (i.e. see MC plots 602 and 604 between two elements along electrical field plane (MC1) and magnetic field plane (MC2) respectively, in reference to the 16 dB line 608). As will be appreciated by the person of ordinary skill in the art, these exemplary results provide a considerable improvement in patch antenna and antenna array performance, without compromising requirements for low side lobes, for example, in the context of bi-sector or planar-sector arrays.

Figure 13:
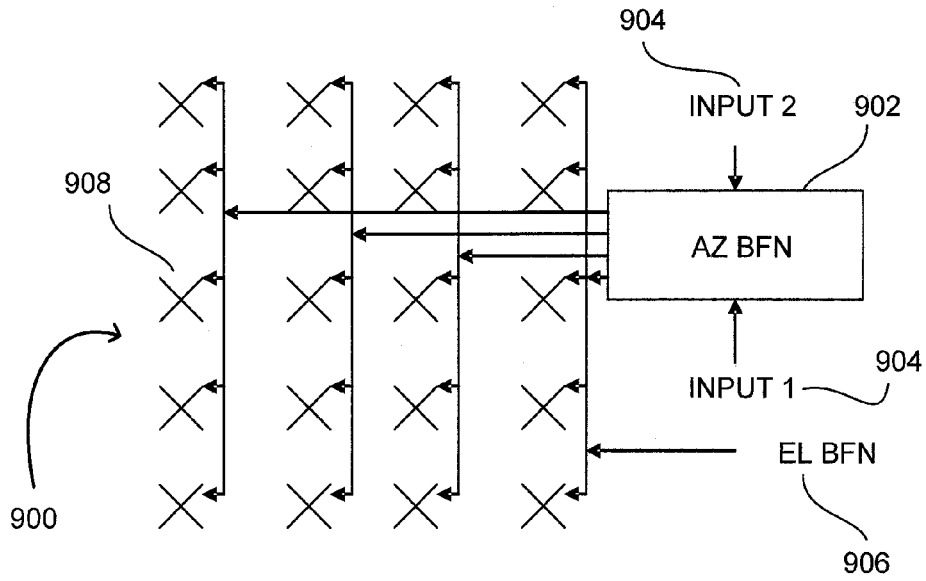
FIG. 13 is a diagrammatic representation of an antenna array comprising a Fixed Electrical down-Tilted angle (FET) and an array of patch elements.
Figure 14:
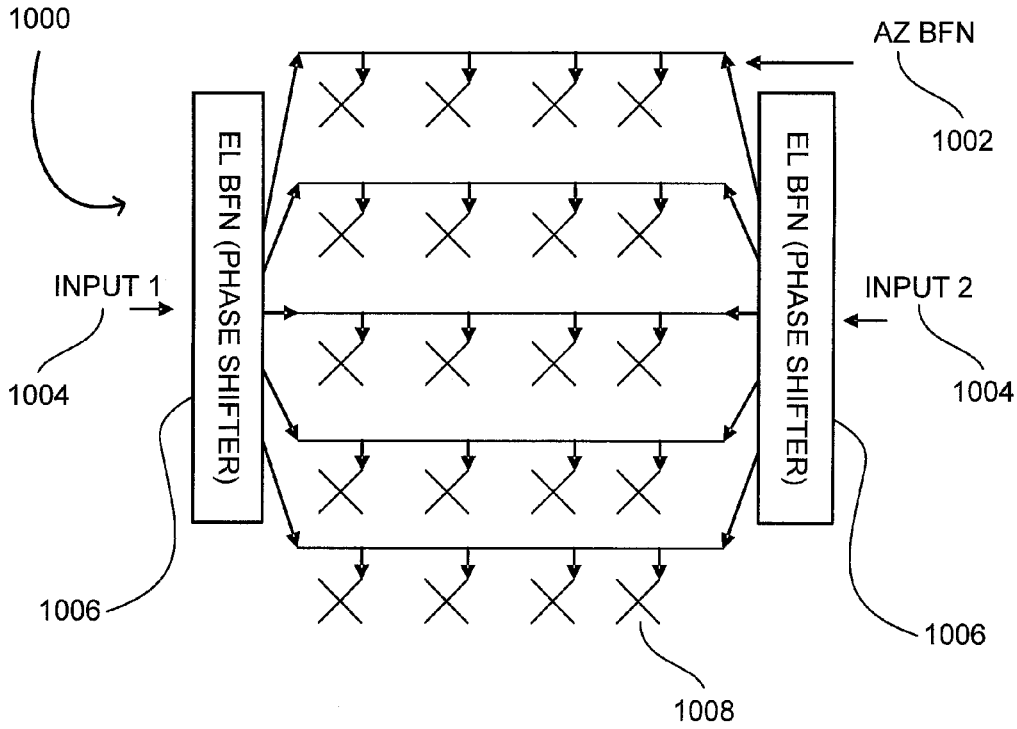
FIG. 14 is a diagrammatic representation of an antenna array comprising a Variable Electrical down-Tilted angle (VET) and an array of patch elements.

As shown in the above examples and as will be appreciated by the person of ordinary skill in the art, anti-phase capacitive coupling in dual polarization fed patch antenna elements may lend itself to improved performance, which, for example, may be particularly beneficial in bi-sector and/or planar array applications. FIGS. 13 and 14 provide different examples of bi-sector arrays, in accordance with different embodiments of the invention, which may be beneficially designed using the patch antenna technology described above, namely as the azimuth and elevation spacings between adjacent rows and columns of patch elements in such arrays may impose performance constraints at least partially addressed by the provision of the substantially balanced anti-phase dual polarization feed mechanisms described herein. In general, a bi-sector antenna array comprises a planar antenna array with few columns (normally three, four, or six) and high excitation ratios, and wherein the effective antenna area can be halved in some applications by using the Butler beam-forming network (BFN) or the like to realize the bi-sector array functions. For example, those skilled in the relevant art will understand that exceeding array spacing threshold maxima may introduce grating lobes in the radiated signal, which is generally undesirable. As an exemplary rule of thumb, array elements may be restricted to 0.4-0.6 wavelength spacing in the azimuth plane and 0.7-0.95 wavelength spacing in the elevation plane. Also, reduced wavelength spacing in the elevation plane may be required to avoid possible grating lobes when larger tilted angles are needed. These and other operational and/or configurational requirements and/or advantages of bi-sector arrays, and other patch antenna array applications, should be readily apparent to the person of skill in the art and are therefore not meant to depart from the general scope and nature of the present disclosure.

With reference to FIG. 13 and according to one embodiment, an exemplary antenna system architecture, generally referred to by the numeral 900, suitable for use with a fixed downtilt bisector antenna array is shown. In this example, the planar array comprises a 5 row array (i.e. 5×4) comprising an azimuth BFN 902 for example comprised by a Butler matrix, that receives two inputs 904. The azimuth BFN is coupled to an elevation BFN 906, in this example comprising a column BFN. In this embodiment, the elevation BFN is integrated within the elements and/or element array 908. While useful for bi-sector array applications, this architecture can be particularly well suited for fixed tilt applications. In this embodiment, each input 902 is first past through a 1-to-4 AZ BFNs 904 which then couples to respective 1-to-N EL BFN 906, which drive the antenna elements 908 disposed on five four-element sub-arrays (i.e., N=5). The number of arrays along the elevation plane can be adjusted from 3 to 20 (i.e., N) based on gain and beam requirements of the antenna array, for example. Note that while only 2 inputs are shown, 4 inputs are generally required if implementing such an antenna array as a bi-sector array, namely in generating respective orthogonal beams for two or more distinct sub-sector coverage areas of the antenna.

With reference to FIG. 14 and according to one embodiment, an exemplary antenna system architecture, generally referred to by the numeral 1000, suitable for use with a variable downtilt bisector antenna array is shown. In this example, a Butler matrix is used as an azimuth (AZ) BFN 1002 to control the azimuth beam pattern of the antenna system. Accordingly, an elevation BFN 1006 receives two inputs 1004, which feeds the Butler matrix implemented azimuth BFN 1002. In this embodiment, the azimuth BFN 1002 is integrated with the elements and/or element array 1008. While useful for bi-sector array applications, this architecture can be particularly well suited for variable tilt applications. In this embodiment, each input 1004 is first past through a 1-to-5M EL BFN (phase shifters) 1006 which then couples to respective 1-to-4 AZ BFNs 1002, which drive the antenna elements 1008 disposed on five four-element sub-arrays as shown in FIG. 14. (i.e., M=1). The number of arrays along the elevation plane can be adjusted from 5 to 20 (i.e., 5M with M=1, 2, 3, and 4) based on gain and beam requirements of the antenna array, for example. Note that while only 2 inputs are shown, 4 inputs are generally required if implementing such an antenna array as a bi-sector array.

Figure 15:
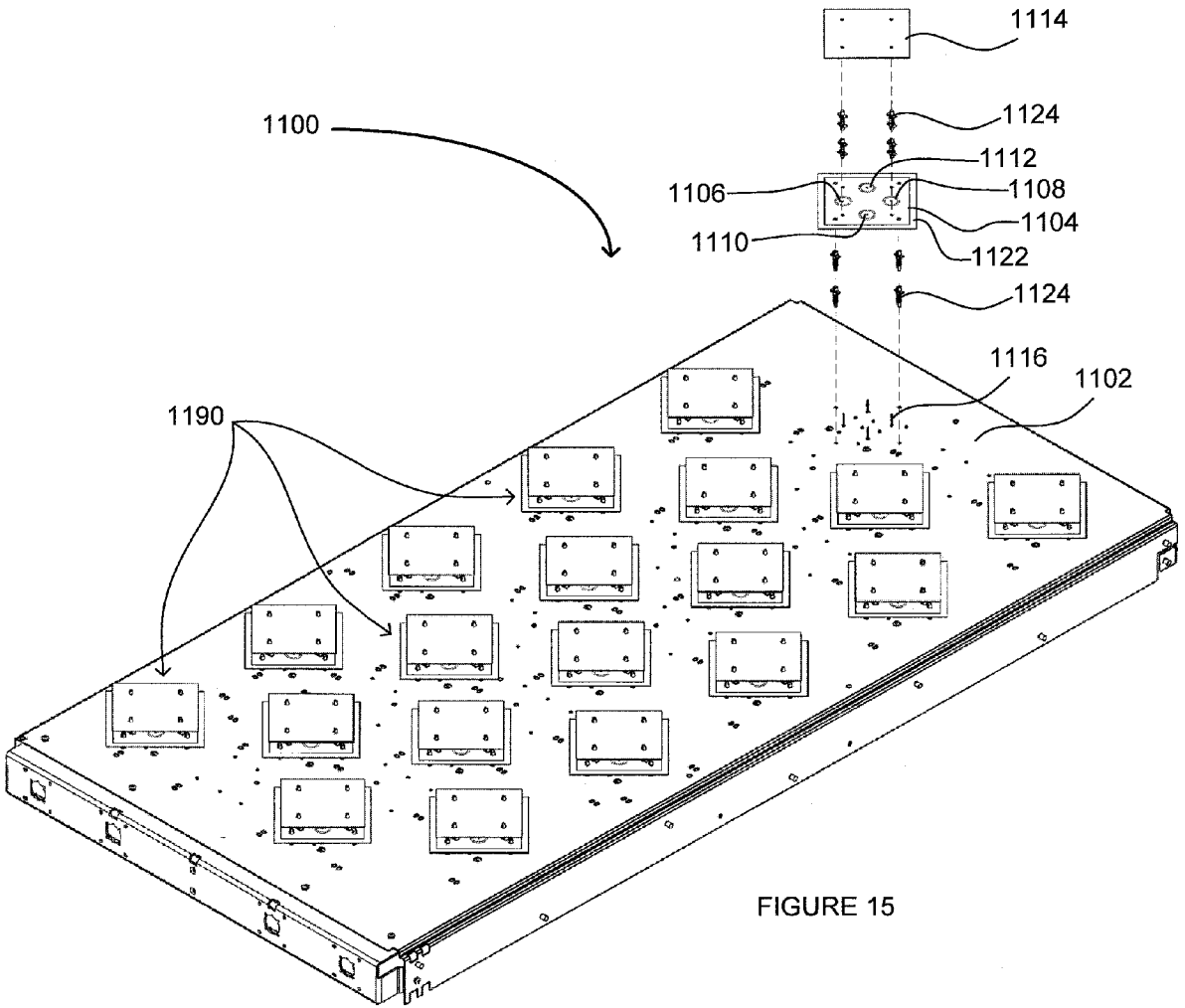
FIG. 15 is a perspective view of an exemplary antenna array comprising a 5×4 array of patch elements as shown in FIG. 9 and driven by the anti-phase feeding network of FIG. 10, for example.

FIG. 15 provides an example of a 5×4 array 1100 of patch elements 1190, for example a shown in FIG. 9. For example, each patch element 1190 illustratively comprises a layered architecture having in sequence a base reflector 1102 (commonly provided for all patches by a metallic surface of the antenna array support structure), a feed mechanism comprising two pairs of diametrically opposed feeding elements (e.g. feed pads 1106 and 1108, and 1110 and 1112 respectively) and two resonators 1104 and 1114 respectively. In this embodiment, the feed pads 1106 to 1112 are fed by respective feeds 1116 and disposed for capacitive coupling to the resonators 1104 and 1114, wherein each pair is configured to feed a respective beam polarization substantially orthogonal to the other, resulting in a substantially balanced dual polarization feed capacitively coupled patch element. In this embodiment, again, the feed pads 1106 to 1112 are disposed within an area circumscribed by the periphery of the resonators 1104 and 1114, and configured for coplanar capacitive coupling to resonator 1104 and layered capacitive coupling to resonator 1114. Once again, feed structures 1116 are inserted through the feeding element support sheet 1122 and extend there from through the base 1102 for operative coupling to driving circuitry, for example provided by a PCB such as shown in FIG. 10. Appropriate support structures, such as non-conductive posts or spacers 1124, are disposed between the resonators and the base. It will be appreciated by the person of skill in the art that various alternative mounting and/or support structures may be considered herein to provide appropriate spacings between patches and/or between a patch and base reflector, without departing from the general scope and nature of the present disclosure.

In this embodiment, the elements 1190 are disposed in a linearly staggered array, which, in one embodiment, may reduce mutual coupling between elements and therefore improve a performance thereof. Such staggered configuration may also improve the elevation pattern of the array by reducing quantization and grating lobes, for example. In one example, such an array may be suitably configured to operate in a communication network, such as a cellular communication network, when mounted and operated at a base station or the like, for instance providing for a system sectorized coverage area, or again, two or more sectorized coverage area when operated as a bi-sector or pluri-sector array. Appropriate beamforming networks, for example as described above with reference to FIGS. 13 and 14, may be incorporated with such an array depending on its intended application, and the type, shape and directionality of beam(s) required therefor. These and other such antenna array configurations and architecture will be readily apparent to the person of ordinary skill in the art and therefore, should not be considered to depart from the general scope and nature of the present disclosure.

Figure 16A:
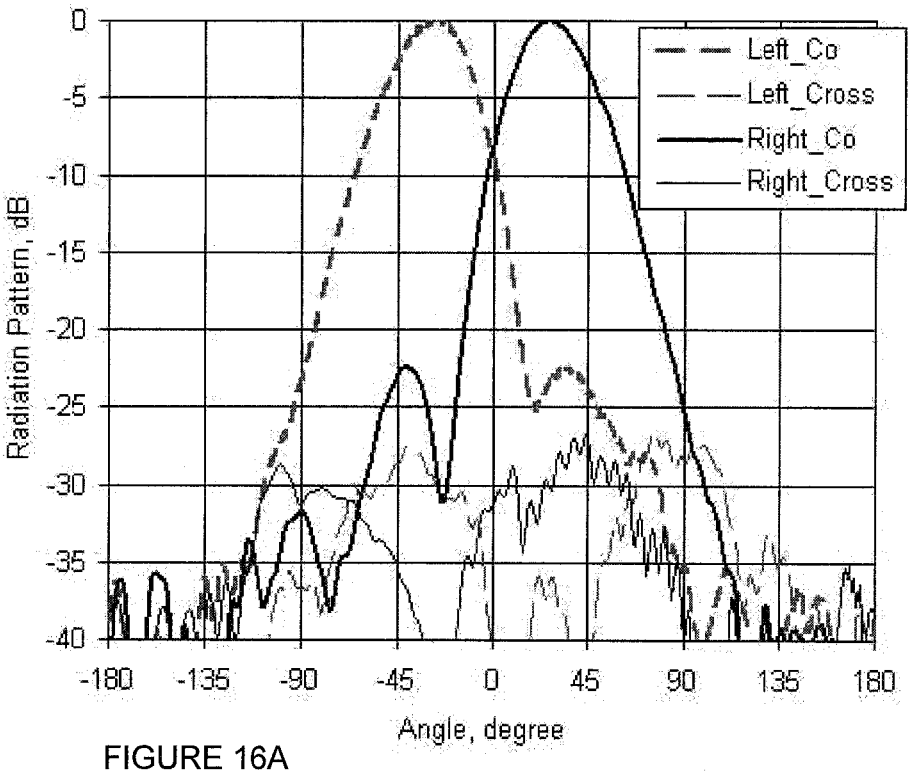
FIGS. 16A and B are plots of measured azimuth and elevation radiation patterns, respectively, of a 5×4 array of patch elements with a FET array architecture set at a 4 degree down-tilt angle and operating at 896 MHz.
Figure 16B:
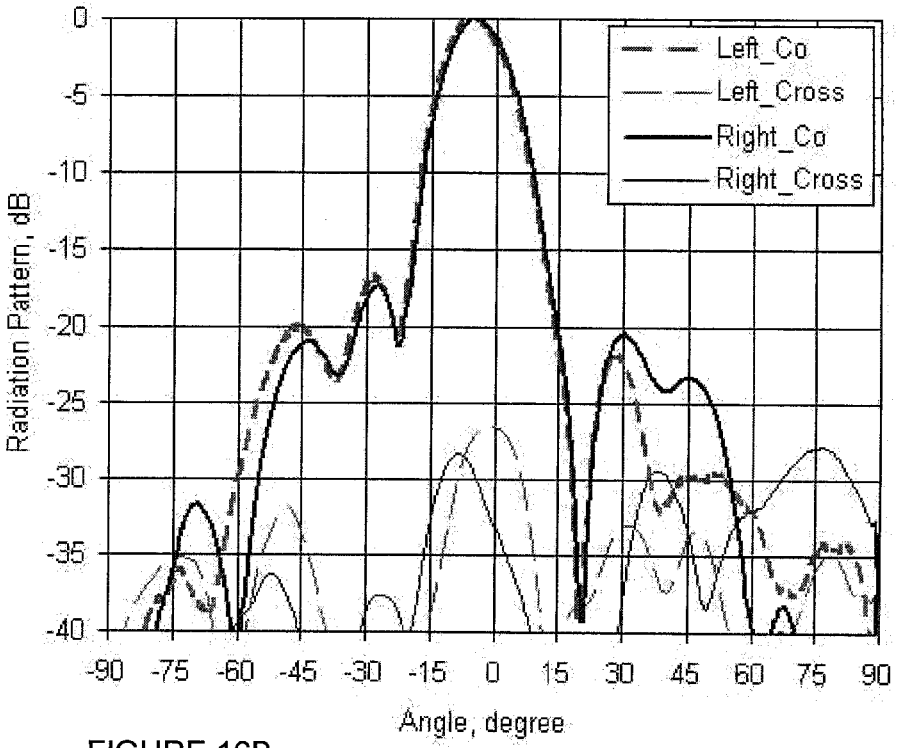

FIGS. 16A and B are plots of measured azimuth and elevation radiation patterns, respectively, of a 5×4 array of patch elements, for example as shown in FIG. 9, with a FET array architecture set at a 4 degree down-tilt angle and operating at 896 MHz. Respective plots are provided demonstrating cross-polarization discrimination (XPD) and side lobe levels (SLL) using this array.

Figure 17A:
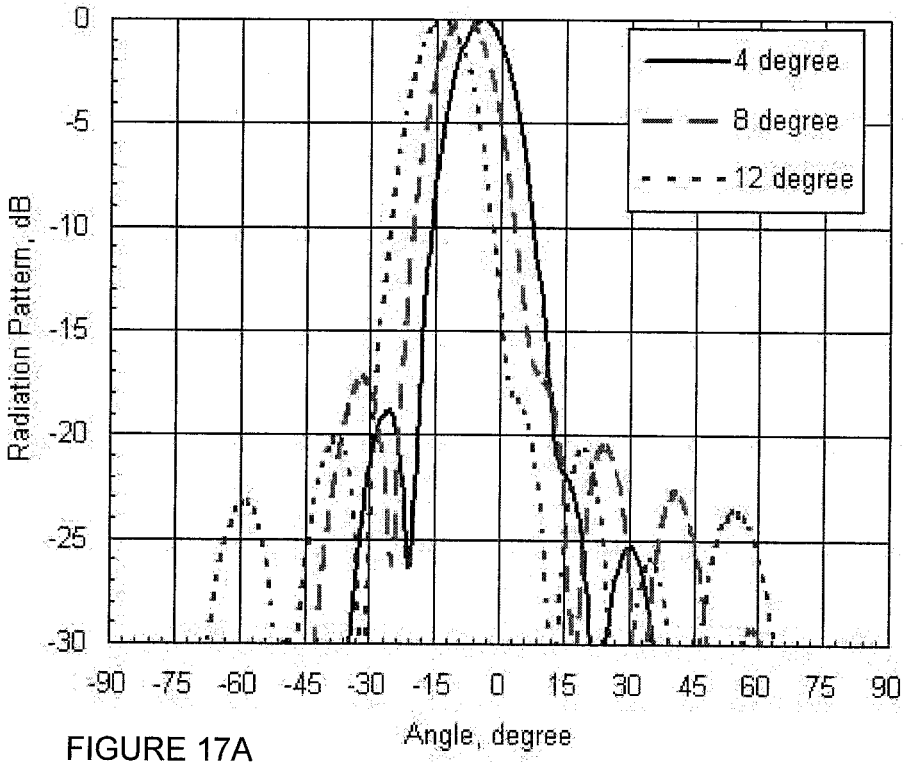
FIGS. 17A and B are plots of measured co-polarization and cross-polarization elevation radiation patterns, respectively, of a 5×4 array of patch elements with a VET array architecture set at a 4, 8 and 12 degree down-tilt angle and operating at 896 MHz.
Figure 17B:
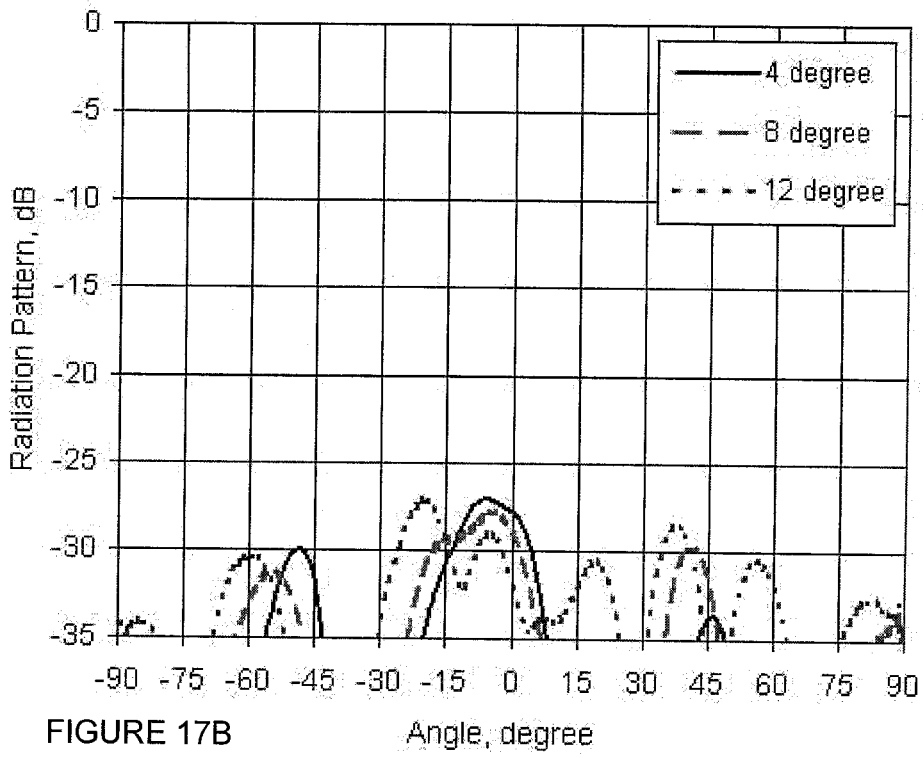

FIGS. 17A and B are plots of measured co-polarization and cross-polarization elevation radiation patterns, respectively, of a 5×4 array of patch elements, for example as shown in FIG. 9, with a VET array architecture set at a 4, 8, and 12 degree down-tilt angle and operating at 896 MHz.

It will be appreciated by the person of ordinary skill in the art that other antenna configurations and/or applications may be considered herein, for example by combining different groups and/or subgroups of elements as described illustratively herein, to provide a desired effect, without departing from the general scope and nature of the present disclosure.

We claim:

1. A patch antenna element for generating orthogonal beams comprising one or more resonators, a base reflector, and a dual feed mechanism, said dual feed mechanism comprising two pairs of feeding elements capactively coupled to at least one of the one or more resonators via substantially coplanar anti-phase capacitive coupling, each of said pairs comprising substantially balanced feeds configured to be driven via respective anti-phase signals to respectively generate the orthogonal beams.

2. The patch antenna element of claim 1, comprising two substantially stacked resonators.

3. The patch antenna element of claim 2, wherein said two pairs of feeding elements are disposed in adjacent proximity to an inner one of said stacked resonators and thereby layered relative to an outer one of said stacked resonators.

4. The patch antenna element of 3, wherein said pairs of feeding elements are disposed within an area circumscribed by said inner resonator.

5. The patch antenna element of claim 1, wherein said substantially coplanar anti-phase capacitive coupling comprises layered capacitive coupling.

6. The patch antenna element of claim 1 comprising a single resonator with substantially coplanar feeding elements.

7. The patch antenna element of claim 1, further comprising a dielectric material disposed between said feeding elements and at least one or said one or more resonators layered relative thereto.

8. The patch antenna element of claim 1, wherein said feeding elements are disposed within an area circumscribed by a periphery of said one or more resonators.

9. The patch antenna element of claim 1, wherein at least one of said one or more resonators is selected from the group consisting of an embedded metal resonator within a dielectric material, a printed metal resonator on a dielectric material and a metal sheet.

10. The patch antenna element of claim 1, wherein at least one of said one or more resonators is of a shape selected from the group consisting of a square, a rectangle, a circle and a ring.

11. The patch antenna element of claim 1, wherein at least one of said one or more resonators is manufactured of a conductive material selected from the group consisting of aluminum, copper, silver, iron, brass, tin, lead, nickel, gold and mixtures thereof.

12. The patch antenna element of claim 1, wherein at least one of said one or more resonators is embedded in a dielectric material selected from the group consisting of Duroid, Gtek, FR-4, and mixtures thereof.

13. The patch antenna element of claim 1, wherein at least one of said one or more resonators is disposed on one of a dielectric material and a composite dielectric material, wherein said dielectric material is selected from the group consisting of polystyrene, polycarbonate, Kevlar, Mylar and mixtures thereof, and said composite dielectric material is selected from the group consisting of Duroid, Gtek, FR-4 and mixtures thereof.

14. The patch antenna element of claim 1, wherein at least one of said one or more resonators comprises a high conductivity ink printed on one of a dielectric material and a composite dielectric material.

15. The patch antenna element of claim 1, wherein a shape of said feeding elements is selected from the group consisting of squares, rectangles and circles.

16. The patch antenna element of claim 1, further comprising a feeding network operatively coupled to said feeding elements for constructing said anti-phase signals, comprising one of cabling, a printed circuit board and a combination thereof.

17. The patch antenna element of claim 16, wherein said feeding network comprises a PCB capacitively coupled to said base reflector.

18. A method of generating orthogonal beams using a patch antenna element comprising one or more resonators, the method comprising:

capacitively coupling two pairs of substantially balanced feeding elements with at least one of the one or more resonators via substantially coplanar anti-phase capacitive coupling; and driving said feeding elements of each of said pairs via respective anti-phase signals to respectively generate the orthogonal beams.

19. The method of claim 18, wherein said coupling step comprises capacitively coupling said pairs of feeding elements with at least one of said resonators via layered capacitive coupling.

20. The method of claim 18, the patch antenna element comprising stacked resonators, said coupling step comprising capacitively coupling said feeding elements with an inner one of said resonators via the substantially coplanar anti-phase capacitive coupling and thereby coupling said feeding elements with an outer one of said resonators via layered capacitive coupling.

21. The method of claim 18, wherein the orthogonal beams comprise oppositely circularly polarized beams, and wherein said driving step comprises driving said feeding elements via respective quadrature phase signals.

22. A patch antenna for generating orthogonal beams, comprising an array of patch elements each contributing to the orthogonal beams and comprising one or more resonators, a base reflector, and a dual feed mechanism, said dual feed mechanism comprising two pairs of feeding elements capacitively coupled to at least one of the one or more resonators via substantially coplanar anti-phase capacitive coupling, each of said pairs comprising substantially balanced feeds configured to drive and generate, via respective anti-phase signals, a respective one of the orthogonal beams.

23. The patch antenna of claim 22, further comprising one or more beamforming networks for driving said feeding elements in controlling a radiation pattern of the orthogonal beams.

24. The patch antenna of claim 23 comprising a bi-sector array for generating respective radiation patterns in two or more sub-sector coverage areas.

25. The patch antenna of claim 23, configured to operate as a Fixed Electrical down-Tilted (FET) antenna.

26. The patch antenna of claim 23, configured to operate as a Variable Electrical down-Tilted (VET) antenna.

27. The patch antenna of claim 22, wherein said array of patch elements are disposed in a linearly staggered configuration.

28. The patch antenna of claim 22, each said patch element comprising two substantially stacked resonators wherein said feeding elements are disposed in adjacent proximity to an inner one of said stacked resonators and thereby layered relative to an outer one of said stacked resonators, and wherein said feeding elements are disposed within an area circumscribed by said inner resonator.

* * * * *